United States Patent [19]

McGuire et al.

[11] Patent Number: 4,826,168

[45] Date of Patent: May 2, 1989

[54] INTERCHANGEABLE AND ADJUSTABLE GOLF CLUB GRIP

[76] Inventors: George W. McGuire, 7056 W. Sprucewood, Las Vegas, Nev. 89117; Virginia L. Shallenberger, 5839 Cherrywood Dr., Lorain, Ohio 44053

[21] Appl. No.: 114,760

[22] Filed: Oct. 30, 1987

[51] Int. Cl.[4] ..... A63B 69/36

[52] U.S. Cl. ..... 273/81.2; 273/81 C; 273/81.4

[58] Field of Search ..... 273/81 C, 81.2, 81 R, 273/81 A, 81 B, 81 D, 165, 81.4

[56] References Cited

U.S. PATENT DOCUMENTS

| | | | |
|---|---|---|---|
| 2,091,512 | 8/1937 | Marsh | 273/81.4 |
| 2,225,839 | 12/1940 | Moore | 273/81 C |
| 3,087,729 | 4/1963 | Sullivan | 273/81.2 |
| 3,179,435 | 4/1965 | Miller | 273/81.2 |
| 3,245,686 | 4/1966 | Hartmeister | 273/81.2 |
| 4,365,807 | 12/1982 | Melby | 273/81.4 |

FOREIGN PATENT DOCUMENTS

| | | | |
|---|---|---|---|
| 492684 | 9/1938 | United Kingdom | 273/81.2 |

*Primary Examiner*—George J. Marlo

*Attorney, Agent, or Firm*—Seiler, Quirk & Tratos

[57] ABSTRACT

A golf club, especially a putter, has a grip portion with a shaft-receiving chamber having a cross-sectional dimension to enable the grip to be freely rotatable around the shaft. The grip is fastened to the shaft by means of an axial locking mechanism mounted at an upper portion of the grip and concealed by an end cap. The locking mechanism generally consists of a threaded member axially mounted through a transverse wall at an upper portion of the grip which engages a fastening lug attached to the shaft. In a preferred embodiment, locking of the grip to the club is effected by means of an expandable skirt or plug portion of the grip which inserts into the end of the club shaft, and which is compressed to laterally expand the plug to preclude relative movement of the grip and the shaft. Compression of the plug may be actuated by a nut and bolt or a lever-operated cam mechanism.

20 Claims, 2 Drawing Sheets

INTERCHANGEABLE AND ADJUSTABLE GOLF CLUB GRIP

BACKGROUND OF THE INVENTION

This invention relates to a grip design for golf clubs. More particularly, it relates to a specific grip device which is easily interchangeable with other grips and which can be rotationally adjusted on the shaft easily and precisely by a golfer.

In the game of golf, putting is arguably the most important stroke, since a putter is used many more times than any other club carried by a golfer. The putting stroke does not involve strength or quickness, and good putting is characterized by consistency and steadiness. Putting is also the most psychologically affected stroke in golf, often being characterized as an "art" rather than a "science", with such adjectives as "touch" and "feel" frequently being used to describe a successful putting stroke. Many professional golfers have commented that many variations of putters and putting strokes are acceptable for good putting, as long as the golfer has confidence that his particular stroke and club will get the job done.

When a golfer loses his putting touch, it is not uncommon for him to change clubs, grips, or the method of holding the club and striking the ball, in an effort to regain his confidence and improve putting results. Technically, it is possible to design a club which is adjustable in many ways, so that theoretically a golfer could make adjustments in the club even during a round in an effort to overcome putting problems. However, U.S.G.A. rules do not permit the use of adjustable clubs.

According to the present invention, a golf club grip is provided which can be easily mounted on a conventional hollow steel shaft or on a solid shaft by the golfer himself. The grips can be easily interchanged, replacing grips on the same shaft or replacing a shaft on a favorite grip, without sending the club off to a shop. In addition, the precise adjustment of the angular rotational orientation of the grip with respect to the club head may also be precisely determined. This is necessary because many grips have a contoured or longitudinally flat portion to assist the golfer in maintaining the correct alignment of his hands on the club. If this guide portion of the grip is not aligned precisely with respect to the putter blade, a golfer may not feel comfortable in his setup. The invention permits a very simple and rapid adjustment of the angle of the grip and club head with the use of a wrench or screwdriver. Normally, grips are frictionally fitted by pulling them over the end of the club shaft, using a vise in a shop; nonetheless, the precise alignment of grip contour with the putter blade is elusive.

Many types of grips have been known for use on golf clubs, including putters. Verderber, U.S. Pat. No. 2,475,927 shows a golf club having a extendable shaft for varying the length of the club. Biggs, U.S. Pat. No. 3,109,653, and Steiner, U.S. Pat. No. 3,070,370, show golf club grips having a variable cross-sectional diameter. Wheeler, U.S. Pat. No. 3,524,646 shows a golf club having threaded fittings at each end of the shaft for modification of the grip and club head. Williams, U.S. Pat. No. 2,949,304 and Hugman, U.S. Pat. No. 2,876,010 show grips positioned on a shaft by means of radial set screws. Henry et al, U.S. Pat. No. 1,201,728 shows a club having a laterally flexible grip portion.

It is an object of the present invention to provide a golf club grip which can be easily mounted and dismounted by a golfer by means of a single screw or other fastening device at the end portion of the shaft. It is a further object of the invention to provide a putter with a rotationally adjustable grip but which has no visible adjustment mechanism. It is yet a further object of the invention to provide an interchangeable grip which can be removed and replaced quickly and easily by a golfer with only the use of a simple wrench or screwdriver, thus customizing the grip for the individual golfer. These and other objects of the invention will be apparent from the following detailed description thereof.

BRIEF SUMMARY OF THE INVENTION

A golf club has an elongate cylindrical shaft having a club head at one end and a molded resilient grip at the other end. The club shaft may be solid or hollow. The grip has an elongate shaft-receiving chamber at a lower portion thereof, the chamber being dimensioned such that the cylindrical shaft is freely rotatable within the chamber. The grip has a wall extending transversely to the shaft receiving chamber and forming an upper end portion thereof, with an axial opening extending through the wall means and communicating with the shaft receiving chamber. The grip also comprises fastening means for attaching the grip to the shaft which includes a fastening member extending through the axial opening to engage the shaft. The grip is enclosed at its upper end by means of a cap which conceals the adjustment means from external visibility. Modification of the overall structure of the grip is possible; for example, it can be fabricated from a cast or machined base and wrapped with a rubber or leather covering to provide the proper gripping surface.

In a preferred embodiment, the fastening means comprises a threaded member which extends through the opening in the wall means and engages a threaded plug at the upper end of the shaft. In another preferred embodiment, the grip is affixed to the shaft by means of a resilient skirt which extends from the wall downwardly into the shaft. The skirt has an axial passageway extending therethrough which registers with the axial opening in the wall. The fastening means in this embodiment includes actuating means for longitudinally compressing the skirt, causing lateral expansion of the skirt and frictional engagement of the external periphery of the skirt with the internal wall of the shaft. The actuating means is rotationally operated manually by the golfer.

BRIEF DESCRIPTION OF THE DRAWINGS

The invention is best understood with reference to the drawings, in which.

DETAILED DESCRIPTION OF A PREFERRED EMBODIMENT

Figure 1:
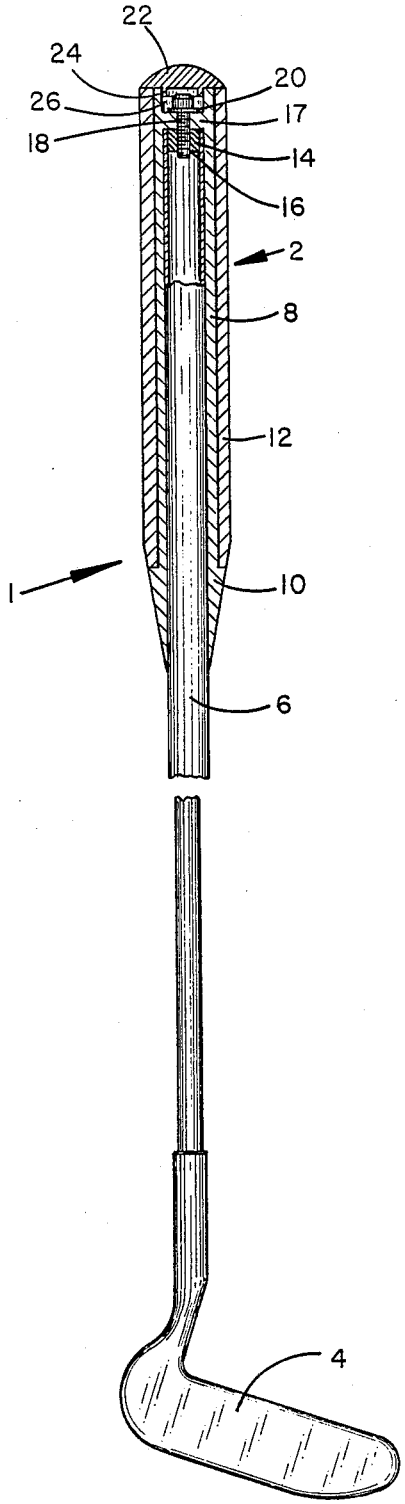
FIG. 1 is a side elevational view, partly sectioned, of a golf club of the invention.

FIG. 1 shows a relatively simple, straight-forward embodiment of a golf club grip according to the invention. Putter 1 has a hollow steel shaft 6 having a club head 4 at one end thereof and a handle or grip portion 2 at a distal or other end thereof. An adjustment sleeve 8 having a tapered portion 10 at a lower end thereof is mounted on the shaft at its upper end. A tubular grip 12 (which, if desired can be integral with the sleeve 8) is coaxially mounted to the sleeve; the grip is generally fabricated from a resilient rubber, plastic, or leather material to provide a comfortable grip for the golfer. A cylindrical plug 14 having an axial bore 16 is permanently fastened in the opening at the top of the shaft by means of soldering or a permanent bond adhesive, such as an epoxy resin, or other permanent fastening means. A screw 18 extends through a locking washer 20 and a flange portion 17 in sleeve 8, engaging the threaded bore 16 of the plug, thereby effectively locking the grip to the shaft. An end cap 22 having a neck portion 24 is frictionally engaged in the recess or chamber 26 in the end of sleeve 8, thereby effectively concealing the locking mechanism. As is easily apparent, in order to remove the grip or adjust the rotational angle of the grip, a golfer need only remove the cap, and remove or loosen the screw 18, as necessary, to change or adjust the grip. When the cap is replaced, the club has the appearance of a normal club having no visible difference from any other non-adjustable club.

Figure 2:
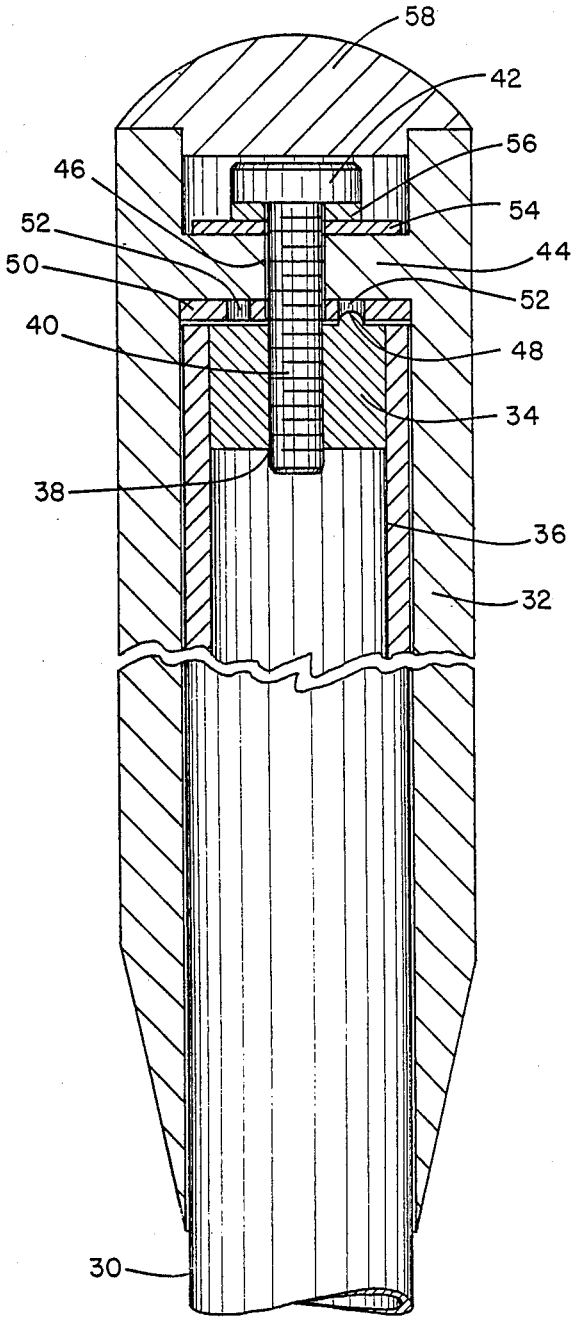
FIG. 2 is a sectioned view of another embodiment of the grip of the invention.

An alternate but similar embodiment of the invention is shown in FIG. 2. A hollow steel shaft 30 has a molded grip 32 mounted over the end of the shaft. The grip is commonly injection molded from a resilient material, such as natural or synthetic rubber, plastic or elastomer. A cylindrical plug 34 having a threaded axial bore 38 is mounted by permanently securing the plug to the inner wall 36 of the shaft by means of solder, an epoxy adhesive or the like. A screw having a threaded shaft 40 and a head portion 42 extends through a washer 54, a lock washer 56, and through a hole 46 in a flange or transverse wall portion 44 of the grip, to engage the threaded bore 38 of the plug.

The embodiment of the invention shown in FIG. 2 also contains an indexing or registration means for fixing the rotational orientation of the handle in one of a series of predetermined positions relative to the club head. The plug 34 has a detent 48 extending upwardly therefrom for the purpose of engaging one of a series of radial holes 52 in detent plate 50 which is permanently mounted to the underside of flange 44. If desired, the detent plate may be fabricated integrally with the grip by forming a plurality of holes or bores in a circular pattern around the underside of the flange. These holes are located around a fixed radius so as to engage the detent in the plug. Similar to the design of FIG. 1, an end cap 58 frictionally mounts in the recess at the end of the grip 32. If desired, other known methods of registering the shaft and grip may be used.

Figure 3:
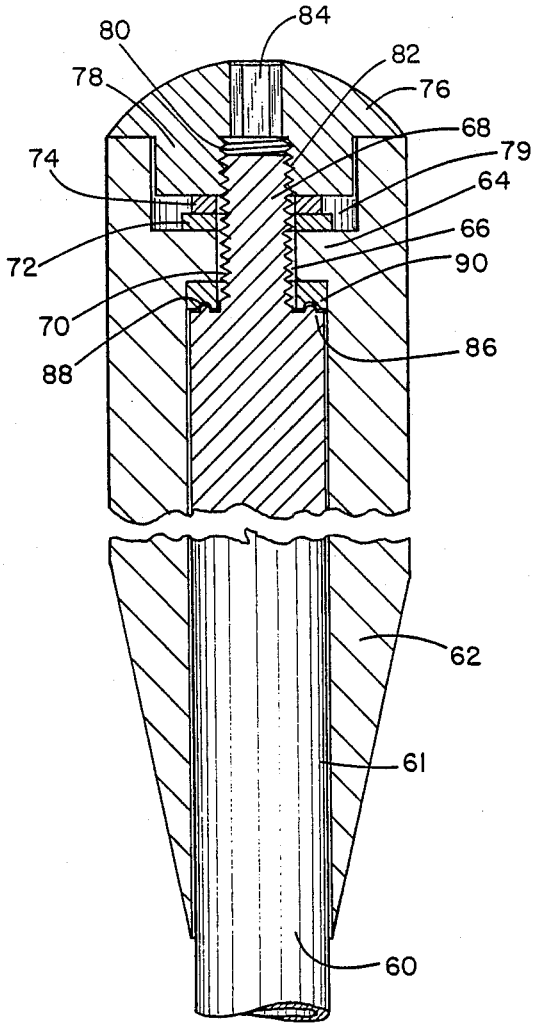
FIG. 3 is an embodiment showing a grip of the invention mounted on a solid shaft club.

FIG. 3 shows an embodiment of the invention which includes a grip which mounts over the end of a club having a solid shaft. For many years, the use of solid wooden shafts was common; these shafts are still in use today, particularly on some putter designs, and have been supplemented by solid shafts of many high technology materials, such as epoxy/graphite fiber composites. As shown in FIG. 3, a club having a solid shaft 60 and a molded grip 62 with an internally projecting circular flange or wall 64 is shown. An axial opening 66 having a circular cross section receives a lug 68 having male threads 70. Attachment of the grip to the shaft is effected by means of a threaded cap 76 mounted at the end of the grip. The cap has a rounded end and a neck portion 78 which extends into a cylindrical recess 79 at the end of the grip. A threaded bore 80 having female threads 82 engages the threaded lug 68 on the end of the shaft. A washer 72 and lock washer 74 assure that the cap will not loosen accidentally or through use. The cap has a central hexagonal channel 84 for receiving an allen wrench for loosening or tightening the cap. If desired, a slot or other type of channel for receiving a tool may be used in place of the hexagonal channel.

A horizontal wall or flange 86 on the shaft at the base of the lug has a plurality of radially disposed detents 88 which engage an indexing or registration means 90 which is permanently attached to wall 64; as shown, the indexing means is a washer having a plurality of indentations located radially about its surface. If desired, the indexing means can simply b a plurality of indentations or bores in the lower surface of the grip flange 64 which abuts the upper flange 86 of the shaft. Wall means 64 is a transverse partition between the axial cylindrical shaft-receiving opening 61 at a lower portion of the grip and the recess 79 at the upper end thereof. The fastening means between the grip and the shaft mounts on the wall 64.

In another embodiment using a solid shaft (not shown), the grip design shown in FIGS. 1 and 2 can be used, but instead of fastening a threaded lug (e.g., 34) at the end of the hollow shaft, an axial threaded bore is drilled into the end of the solid shaft. Accordingly, a screw can be passed through the grip flange and attached directly to the end of the shaft.

Figure 4:
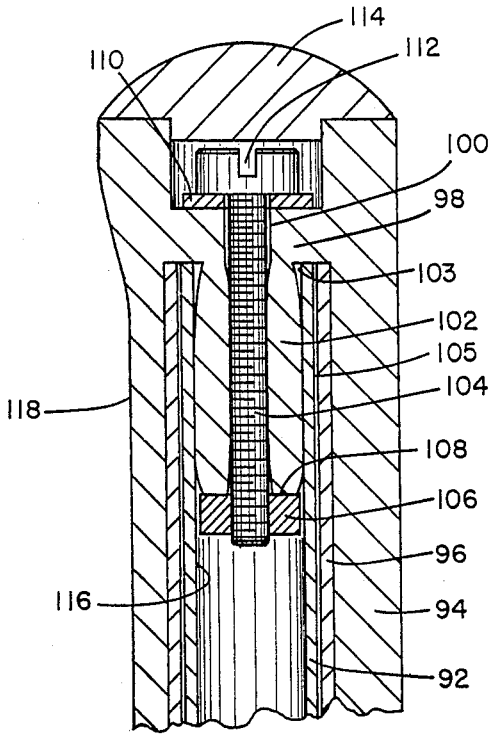
FIG. 4 is a sectioned partial view of another embodiment in which the locking mechanism comprises an expandable plug in the hollow shaft.

Yet another and preferred variation of the grip of the invention is shown in FIG. 4. A hollow steel shaft 92 carries a grip 94 of the invention molded from a resilient material. A thin plastic or metal rigid sleeve 96, which is optional, is mounted between the shaft wall and the grip to assist in aligning and sliding the grip along or around the shaft. The cylindrical shaft-receiving chamber at the lower portion of the molded grip is dimensioned to leave a slight clearance 105 between the sleeve 96 and the outside wall of shaft 92 so as to permit rotation of the grip around the shaft when the fastening mechanism (bolt 104 and nut 106) is loose. The grip has an axially oriented sleeve or skirt portion 102 which extends downwardly from the flange portion 98, forming an annular channel 103 between the skirt and the outer grip wall. A bolt 104 extends through a washer 110 and a circular passageway 100 which extends through the flange 98 and the skirt 102. The skirt may have a circular or other integral transverse cross-section, or may comprise one or more discrete legs or projections which extend downwardly from the wall 98 into the interior of the shaft. Bolt 104 engages the nut 106, which in turn draws upwardly on the bottom surface 108 of the skirt, thus longitudinally squeezing and laterally expanding the skirt against the inside wall 116 of the shaft. Friction or other engaging means between the nut 106 and the bottom surface of the skirt permits the threads to engage properly; alternatively, the nut can be molded integrally with the plug. Friction between the inner wall 116 of the shaft and the outer wall of the skirt precludes rotational movement of the grip on the shaft.

As shown in FIG. 4, the grip has a contoured external portion 118 which can be adjusted by the golfer relative to the putter face. Adjustment is effected by removing friction-fitted cap 114 and loosening the locking mechanism by means of a screwdriver which fits into the slot 112 in the head of bolt 104. In a very commonly accepted teaching method for putting, the club is grasped by the golfer with both thumbs pointing straight down the shaft on the "top" or front portion of the grip. To assist golfers attaining this posture, grip manufacturers often mold the grip with a flat portion to enable proper hand placement on the club.

In all embodiments of the invention, it is important that the axial shaft-receiving chamber at the lower portion of the grip have an inside diameter slightly greater than the outside diameter of the shaft. In all current commercial putters, the grip is mounted on the shaft with a very close friction fit, and is secured with adhesive tape, so as to preclude any possible relative rotation of these club components. In the invention, however, a slight annular clearance (e.g., at least about 0.002" to about 0.008") is designed so as to ensure that the grip can be rotated if the axial fastening means is not tightened. The grip should be easily rotatable by a player by gripping the shaft with one hand and the grip with the other and twisting with light torque.

The function of the bolt 104 and nut 106 is to longitudinally compress the resilient plug or skirt means 102, thereby causing it to expand transversely and frictionally engage the inner shaft wall. The particular size and shape of the expandable plug is not critical, as long as compression of the plug precludes rotation of the grip.

The embodiments of FIGS. 1–4 all depict a grip having an axial cylindrical recess at an upper portion and an elongate cylindrical shaft-receiving channel at a lower portion of the grip. The recess and the channel are separated by a transverse wall having an axial opening therethrough to receive a fastening member for attaching the grip to shaft. It is of course important to have some transverse wall to support the fastening means, but the recess is not functionally essential to the design of the invention. If the uppermost end of the grip is a flat wall without a recess, te fastening means can mount above the end of the wall, and can be concealed by a corresponding recess in the cap which hides the fastening member from external visibility. An example of such construction is shown in FIG. 5.

Figure 5:
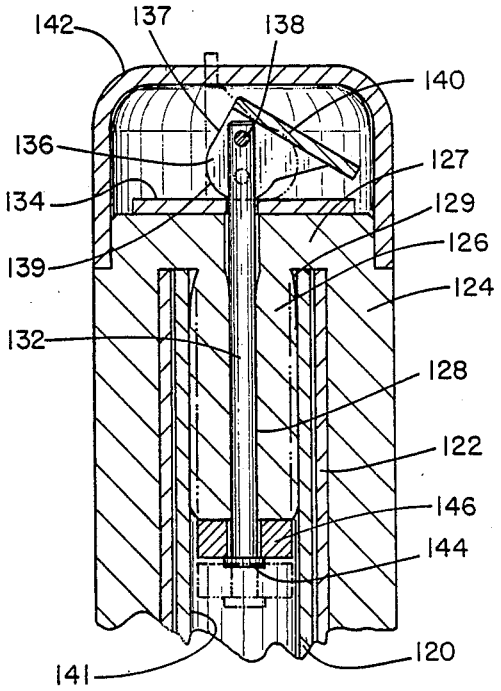
FIG. 5 is an alternate embodiment showing a cam operated locking mechanism for fastening a grip of the invention onto a hollow shaft.

The embodiment shown in FIG. 5 is similar to the one shown in FIG. 4, but uses a different operating mechanism to expand the skirt inside of the shaft. A lever-actuated cam is used to replace the nut and bolt mechanism of FIG. 4. As shown in FIG. 5, hollow club steel shaft 120 has an annular sleeve 122 fabricated from a rigid material mounted around its peripheral circumference. Molded grip 124 extends over the end of the shaft. A resilient skirt or plug means 126 depends from the end wall 127 of the grip, forming annular channel (129) between skirt and outer grip wall with an axial cylindrical channel 128 extending through th upper wall 127 entirely through the longitudinal axis of the sleeve 126. Expansion of the sleeve 126 into the shaft is effected by a lever-operated cam mechanism. A cam 136 having a flat surface 137 and a rounded surface 139 is manually actuated by lever arm 140. The cam is attached to solid cylindrical rod 132 by means of a pivot mount 138. An annular flange or piston 144 at the lower end of the shaft secures a donut shaped support member 146 at the lower end of the shaft. The cam pivots on washer 134. The entire fastening means is covered by an end cap 142 which mounts on the grip. If desired, parts 144 and 146 can be integrally fabricated in one piece. The cam operating mechanism can be replaced by any other pressure-generating mechanism, such as a biased pin.

Operation of the embodiment of the grip shown in FIG. 5 is very simple and is indicated in phantom in the drawing. When it is desired to remove or angularly adjust the grip, the cap is removed and the lever arm 140 is raised into the position shown in phantom in the drawing. This causes the flat surface 137 to ride on the washer, lowering the pivot point 138 and causing the shaft to extend downwardly into the club shaft 120, thereby causing the sleeve 126 to relax and assume the configuration shown in phantom. In this condition, the grip can easily be slid off the end of the club shaft. When it is desired to replace the grip of a different or similar configuration on the shaft, or to fix the angular adjustment of the grip relative to the club face, the lever is pressed downwardly to the position shown in bold in the drawing, raising the support member 146 and compressing the sleeve or plug 126 against the internal wall 141 of the club shaft. The friction between sleeve 126 and the inner wall of the shaft precludes relative movement therebetween.

As is clear from the specific embodiments heretofore disclosed, several different mechanisms for achieving the results sought by the invention are possible. However, all of the grips contemplated by the invention have certain common characteristics. Firstly, in all embodiments, the grip is easily rotatable around the shaft when the axial fastening means is loosened. In other words, the grip does not have a non-rotatable fit characteristic of all current commercial putters. Secondly, the grip is easily removable by loosening a simple axial fastening mechanism, e.g., a lever, screw, or bolt. Thirdly, the means for attachment of the grip to the shaft is not visible when the club is in normal usage. Because a proper putting stroke requires that the golfer concentrate entirely on making the proper stroke, he or she should not be distracted by wondering if the club is in proper alignment. Preferably, the putter has an easily removable end portion, such as a cap, which conceals the adjustment mechanism. Thus, the fastening means to attach the grip to the shaft should operate coaxially with the shaft. The specific fastening means used may depend upon the type of shaft and type of grip desired as well as a user preference.

Accordingly, while the invention has been described with reference to several specific preferred embodiments thereof, it should be understood by those skilled in the art that various changes may be made and equivalents substituted for various elements thereof without departing from the spirit and scope of the invention. In addition, many modifications may be made to substitute different materials, fastening mechanisms, or shapes to the grip of the invention without departing from its essential elements. Accordingly, the invention should not be limited with respect to the embodiments disclosed, but should be defined only by the following claims.

I claim:

1. A golf club comprises an elongate cylindrical shaft having a club head at one end thereof, grip means having a body portion and an elongate shaft-receiving chamber at a lower portion thereof, the chamber being dimensioned such that the cylindrical shaft is freely rotatable within the chamber, wall means extending transverse to the shaft-receiving chamber and enclosing an upper end thereof, an axial opening extending throught the wall means and communicating with the shaft-receiving chamber, and end portion of the cylindrical shaft extending concentrically into the shaft-receiving chamber adjacent the wall means, and fastening means for removably attaching the grip means to the shaft including a fastening member extending through the axial opening and operatively attaching to the shaft, such that loosening of the fastening means permits the grip means to rotate freely around the cylindrical shaft, and tightening the fastening means fixes the rotational orientation of the grip with respect to the club head.

2. The golf club of claim 1 wherein the cylindrical shaft is hollow and has an annular wall of circular cross-section, said golf club also comprising an annular plug mounted in the upper end portion of the cylindrical shaft.

3. The golf club of claim 2 wherein the fastening member engages the annular plug.

4. The golf club of claim 2 wherein the axial bore in the annular plug is threaded and engages a threaded portion of the fastening member.

5. The golf club of claim 2 also comprising registration means for fixing the rotational position of the grip means on the shaft in one of several predetermined rotational positions.

6. The golf club of claim 5 wherein the registration means includes first interengaging lock means spaced radially around the axis of the shaft and fixed with respect to the shaft, and second interengaging lock means adapted to mate with the first interengaging lock means and fixed with respect to the grip means, one of said interengaging lock means having a plurality of locations extending around a transverse circumference around the axis of the shaft.

7. The golf club of claim 1 wherein the cylindrical shaft is solid.

8. The golf club of claim 1 also comprising a rigid sleeve mounted between an exterior wall of the shaft and the grip means.

9. The golf club of claim 1 wherein the body portion is of one-piece construction molded from a resilient material.

10. A golf club comprises an elongate hollow cylindrical shaft having a club head at one end thereof, grip means having a resilient body portion and an elongate shaft-receiving chamber at a lower portion thereof, the chamber being dimensioned such that the cylindrical shaft is freely rotatable within the chamber, wall means extending transverse to the shaft-receiving chamber and enclosing an upper end thereof, an axial opening extending throught the wall means, the cylindrical shaft being slidably inserted into the shaft-receiving chamber with an end portion of the shaft being adjacent to the wall means, resilient skirt means extending downwardly from the wall means interiorly of the hollow cylindrical shaft, actuating means for longitudinally compressing the skirt means, thereby causing lateral expansion of the skirt means and frictional engagement thereof with interior wall of the shaft thereby precluding relative rotation of the grip means with respect to the shaft, and closure means mounted at an upper portion of the grip means to enclose and conceal the actuating means.

11. The golf club of claim 10 wherein the skirt means has a cross-section of an annular ring.

12. The golf club of claim 10 wherein the annular ring has a circular peripheral circumference.

13. The golf club of claim 10 also comprising an axial passageway through the skirt means registering with the opening in the wall means.

14. The golf club of claim 10 also comprising an axial passageway through the skirt means registering with the opening in the wall means, and the actuating means comprises axial threaded bolt means extending through the opening in the wall means and the axial passageway, and threaded support means engaged by the threaded bolt means, said threaded support means contacting a lower surface of the skirt means.

15. The golf club of claim 10 wherein the actuating means comprises a rigid bar extending longitudinally adjacent to the skirt means, a support member operatively connected to the rigid bar and situated adjacent a lower portion of the skirt means, and operating means for moving the rigid bar longitudinally, thereby selectively compressing and releasing the skirt means.

16. The golf club of claim 15 wherein the operating mechanism comprises a cam pivotally connected to an upper portion of the rigid bar, and lever means for moving the cam and the rigid bar between a raised position and a lowered position.

17. The golf club of claim 15 wherein the operating mechanism comprises a bolt, and the support member comprises a threaded nut.

18. A grip member for a golf club, said golf club having an elongate hollow rigid cylindrical shaft connecting the grip member with a club head, said grip member having a body portion and an elongate shaft-receiving chamber at a lower portion thereof, the chamber being dimensioned to rotate freely about the shaft, an end portion of the shaft extending into the shaft-receiving chamber, wall means at an upper portion of the body portion extending transverse to the shaft-receiving chamber and enclosing an upper end thereof, resilient plug means extending from the wall means interiorly of the hollow cylindrical shaft, said wall means and plug means having a straight internal passageway extending coaxially with the shaft-receiving chamber, actuating means movable between a compressed position and a released position for longitudinally compressing the plug means, thereby causing lateral expansion of the plug means, the shaft being freely rotatable within the shaft-receiving chamber when the actuating means is in the released position and being rotatably fixed when the actuating means is in the compressed position.

19. The grip member of claim 18 wherein the actuating means comprises axial threaded bolt means extending through the passageway, and threaded support means engaged by the threaded bolt means, said threaded support means contacting a lower surface of the plug means.

20. The grip member of claim 19 wherein the actuating means comprises a rigid bar extending longitudinally through the passageway, and a support member operatively connected to the rigid bar and situated adjacent a lower portion of the plug means, and operating means for moving the rigid bar longitudinally, thereby selectively compressing and releasing the plug means.

* * * * *